US005417420A

United States Patent [19]

Berg

[11] Patent Number: 5,417,420

[45] Date of Patent: May 23, 1995

[54] TABLE GOLFER AND GOLF COURSE

[76] Inventor: James J. Berg, 7311 Palais Rd., Stanton, Calif. 90680

[21] Appl. No.: 251,345

[22] Filed: May 31, 1994

[51] Int. Cl.[6] ..... A63F 7/06

[52] U.S. Cl. ..... 273/87.2; 273/119 R; 273/129 W

[58] Field of Search ..... 273/85 R, 85 C, 87.2, 273/87.4, 176, 33, 201, 202, 119 R, 129 R, 129 V, 129 W

[56] References Cited

U.S. PATENT DOCUMENTS

| | | | |
|---|---|---|---|
| 1,127,861 | 2/1915 | Connor | 273/87.4 |
| 1,173,818 | 2/1916 | Lins | 273/87.2 |
| 1,391,306 | 9/1921 | Eliaser | 273/129 V |
| 1,573,415 | 2/1926 | Mendes | 273/87.4 |
| 1,869,842 | 8/1932 | Chester | 273/87.4 |
| 2,960,796 | 11/1960 | Woodrey | 273/129 V |
| 3,288,467 | 11/1966 | Rudolph | 273/129 V |

*Primary Examiner*—Sebastiano Passaniti

[57] ABSTRACT

A portable table golfer comprising a base plate positionable in a horizontal orientation on a table, the golfer having a lower surface and an upper surface, a pair of upstanding supports extending upwardly from the upper surface of the base plate with an aperture extending through each, the apertures being at different elevational orientations in axial alignment, a support shaft rotatably supported within the apertures and having a handle at the upper end thereof, a miniature shaft extending downwardly from a central extent of the support shaft with an adjustment mechanism centrally located therein for varying the effective length of the miniature shaft, a golf club head located at the bottom of the shaft with an adjustment mechanism between the lower end of the miniature shaft and the head for varying the angle of the golf club head, a tee located on the upper surface of the base plate for retaining a ball to be hit by the orientation of the shafts.

5 Claims, 4 Drawing Sheets

TABLE GOLFER AND GOLF COURSE

BACKGROUND OF THE INVENTION

1. Field of the Invention

The present invention relates to table golfer and golf course and more particularly pertains to play a miniaturized game of golf with a mechanical golfer on a mechanical golf course.

2. Description of the Prior Art

The use of miscellaneous board games and table games is known in the prior art. More specifically, miscellaneous board games and table games heretofore devised and utilized for the purpose of playing games of skill and chance are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,116,048 to Bilocerkowycz discloses a golf game, apparatus and method therefor.

U.S. Pat. No. 4,790,534 to Jamison discloses a table top golf game.

U.S. Pat. No. 4,461,476 to Tudek discloses a billiard table with center hole and sliding pocket doors for various games of billiards, golf and the like.

U.S. Pat. No. 4,239,217 to Thieme discloses a table top golf game apparatus.

U.S. Pat. No. 3,884,469 to Morton teaches a portable table-top miniature golf game provided with rearrangeable hole modules and separate green putting board.

In this respect, the table golfer and golf course according to the present invention substantially departs from the conventional concepts and designs of the prior art, and in doing so provides an apparatus primarily developed for the purpose of playing a miniaturized game of golf with a mechanical golfer on a mechanical golf course.

Therefore, it can be appreciated that there exists a continuing need for new and improved table golfer and golf course which can be used for playing a miniaturized game of golf with a mechanical golfer on a mechanical golf course. In this regard, the present invention substantially fulfills this need.

SUMMARY OF THE INVENTION

In view of the foregoing disadvantages inherent in the known types of miscellaneous board games and table games now present in the prior art, the present invention provides an improved table golfer and golf course. As such, the general purpose of the present invention, which will be described subsequently in greater detail, is to provide a new and improved table golfer and golf course and method which has all the advantages of the prior art and none of the disadvantages.

To attain this, the present invention essentially comprises a portable table golfer comprising a base plate positionable in a horizontal orientation on a table, the golfer having a lower surface and an upper surface, a pair of upstanding supports extending upwardly from the upper surface of the base plate with an aperture extending through each, the apertures being at different elevational orientations in axial alignment, a support shaft rotatably supported within the apertures and having a handle at the upper end thereof, a miniature shaft extending downwardly from a central extent of the support shaft with an adjustment mechanism centrally located tie,rein for varying the effective length of the miniature shaft, a golf club head located at the bottom of the shaft with an adjustment mechanism between the lower end of the miniature shaft and the head for varying the angle of the golf club head, a tee located on the upper surface of the base plate for retaining a ball to be hit by the orientation of the shafts. A table tennis ball positionable on the tee for being struck by the swinging shaft. A miniaturized golf course comprising a wide rectangular tee area, a generally flat irregularly shaped putting area with a hole and a curved elongated fairway area therebetween whereby the miniaturized golfer may be placed on the tee area and the ball struck along the fairway toward the hole as a function of the length of the miniature shaft, the angle of the club head and the extent of rotation of the support shaft.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved table golfer and golf course which have all the advantages of the prior art miscellaneous board games and table games and none of the disadvantages.

It is another object of the present invention to provide new and improved table golfer and golf course which may be easily and efficiently manufactured and marketed.

It is further object of the present invention to provide new and improved table golfer and golf course which are of durable and reliable constructions.

An even further object of the present invention is to provide new and improved table golfer and golf course which are susceptible of a low cost of manufacture with regard to both materials and labor, and which accordingly are then susceptible of low prices of sale to the consuming public, thereby making such table golfer and golf course economically available to the buying public.

Still yet another object of the present invention is to provide new and improved table golfer and golf course which provide in the apparatuses and methods of the prior art some of the advantages thereof, while simultaneously overcoming some of the disadvantages normally associated therewith.

Still another object of the present invention is to play a miniaturized game of golf with a mechanical golfer on a mechanical golf course.

Lastly, it is an object of the present invention to provide new and improved portable table golfer comprising a base plate positionable in a horizontal orientation on a table, the golfer having a lower surface and an upper surface, a pair of upstanding supports extending upwardly from the upper surface of the base plate with an aperture extending through each, the apertures being at different elevational orientations in axial alignment, a support shaft rotatably supported within the apertures and having a handle at the upper end thereof, a miniature shaft extending downwardly from a central extent of the support shaft with an adjustment mechanism centrally located therein for varying the effective length of the miniature shaft, a golf club head located at the bottom of the shaft with an adjustment mechanism between the lower end of the miniature shaft and the head for varying the angle of the golf club head, a tee located on the upper surface of the base plate for retaining a ball to be hit by the orientation of the shafts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
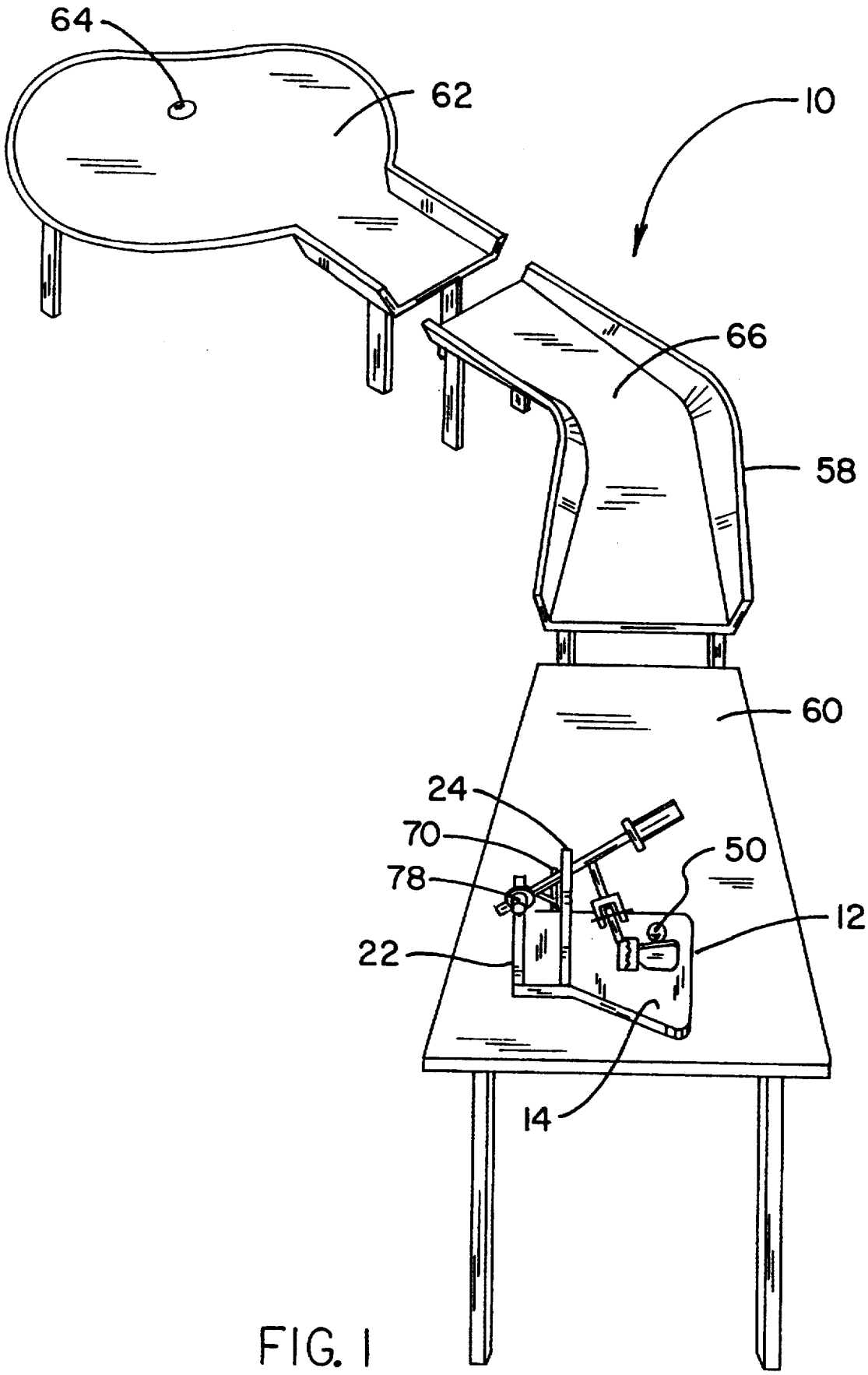
FIG. 1 is a perspective illustration of the preferred embodiment of the new and improved table golfer and golf course constructed in accordance with the principles of the present invention.
Figure 2:
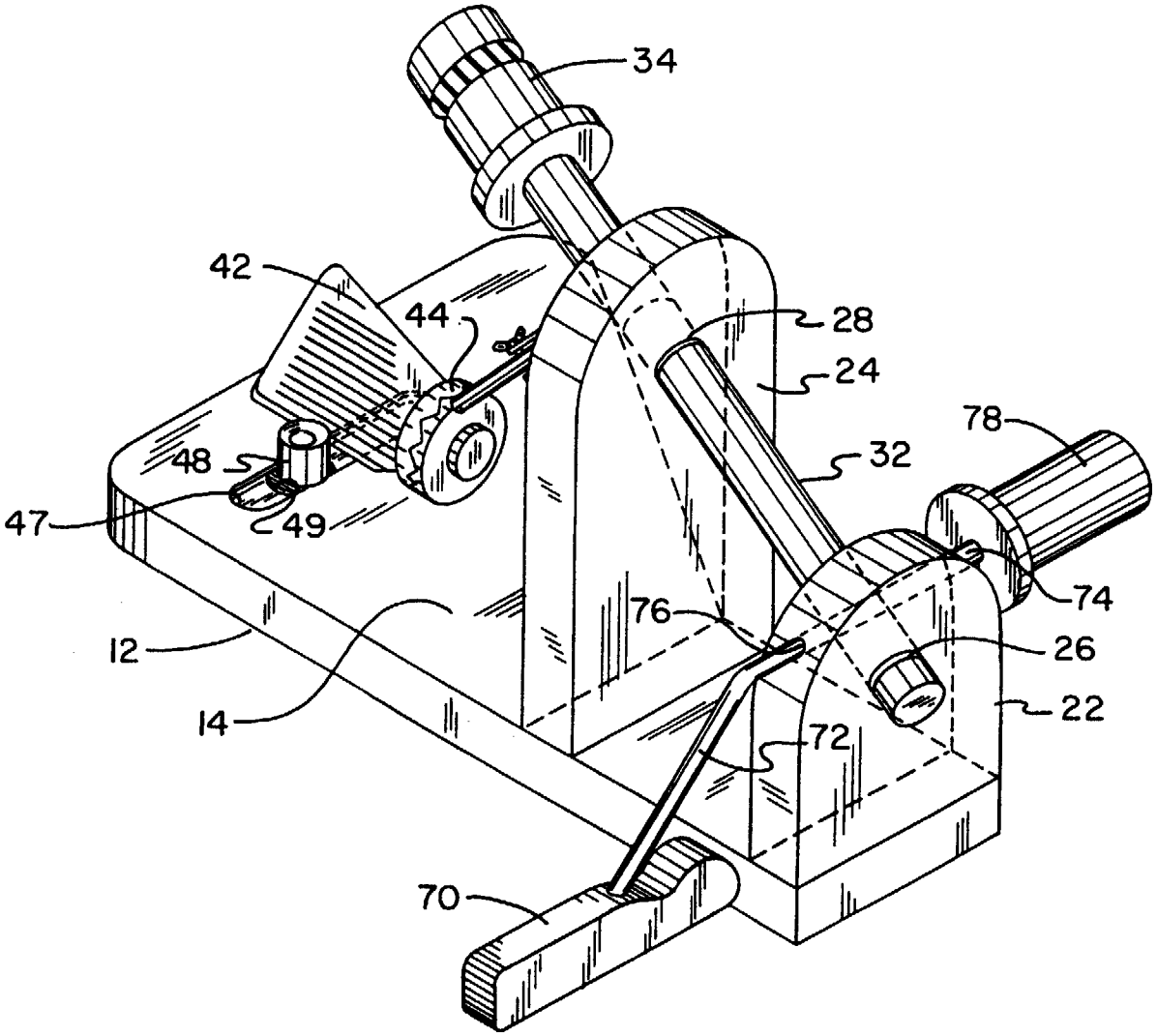
FIG. 2 is a perspective illustration of the golfer device as shown in FIG. 1.
Figure 3:
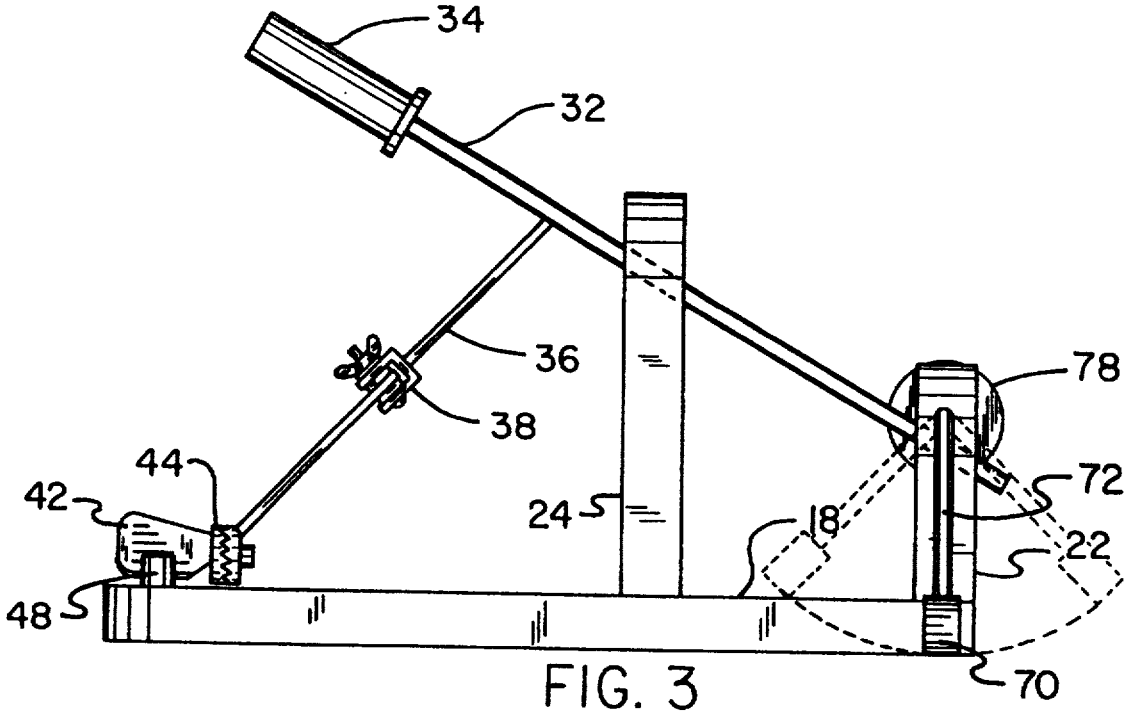
FIG. 3 is a front elevational view of the golfer device shown in the prior Figures.
Figure 4:
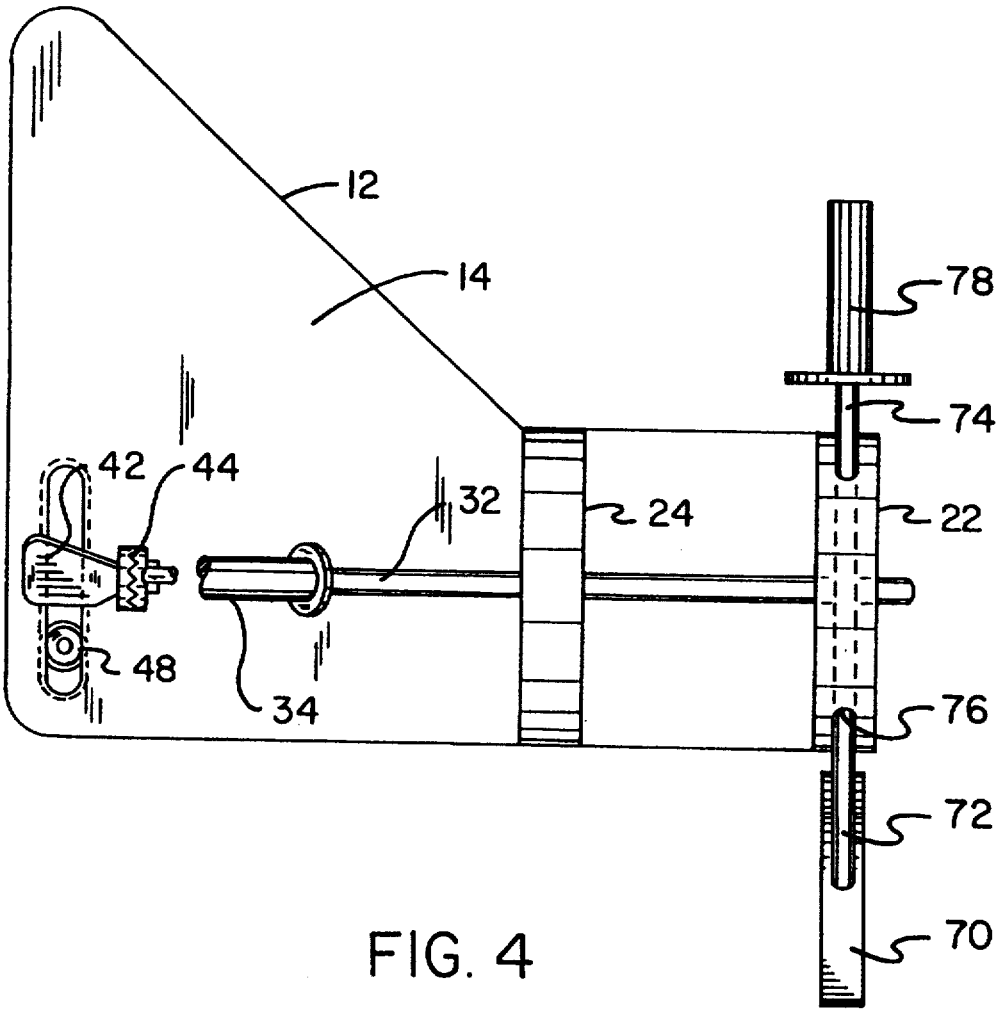
FIG. 4 is a top elevational view of the golfer device shown in FIG. 3.
Figure 5:
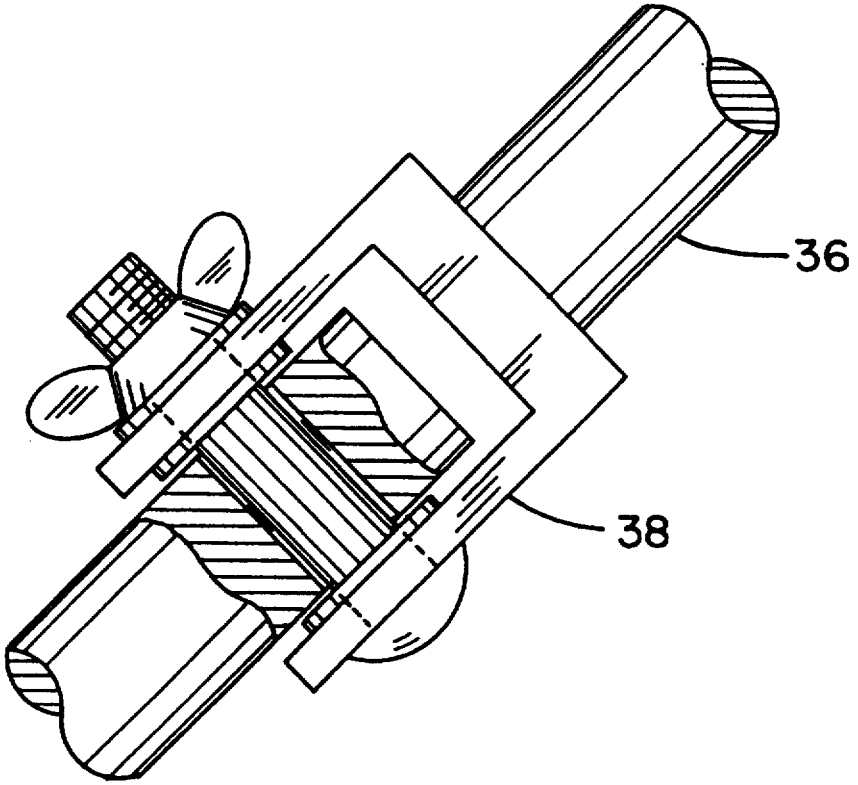
FIG. 5 is an enlarged front elevational illustration partly in cross-section showing the coupling at the central point of the shaft of FIG. 3.
Figure 6:
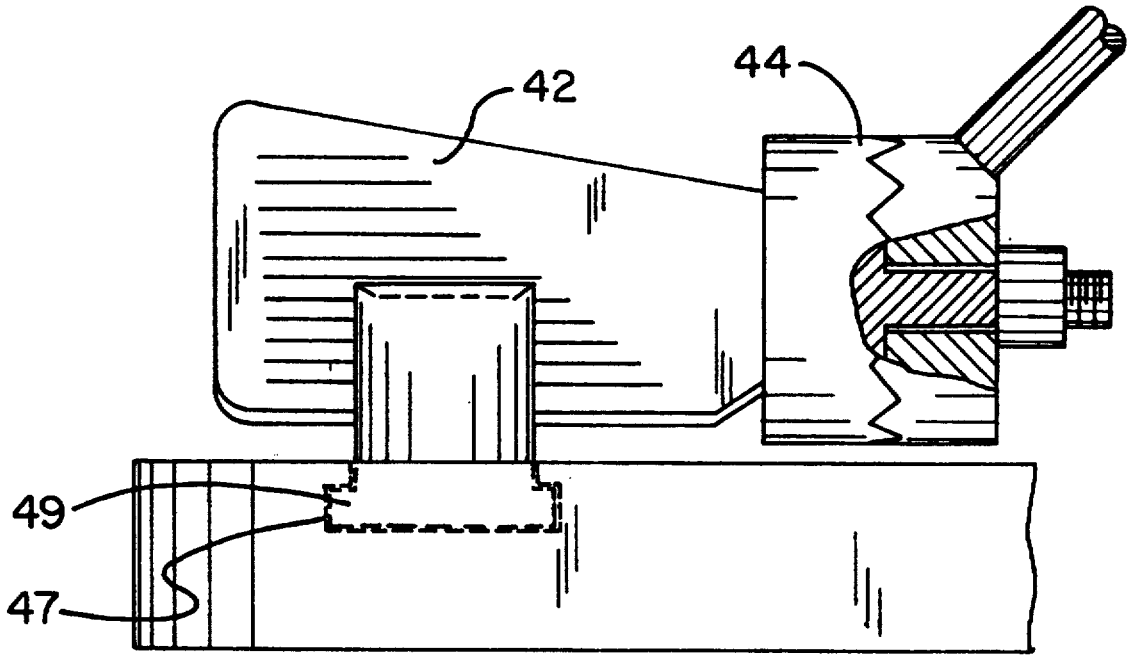
FIG. 6 is an enlarged front elevational illustration of the lower portion of the shaft and golf club head shown in FIGS. 3, 4 and 5.

With reference now to the drawings, and in particular to FIG. 1 thereof, the preferred embodiment of the new and improved table golfer and golf course embodying the principles and concepts of the present invention and generally designated by the reference numeral 10 will be described.

The present invention, the new and improved table golfer and golf course comprises a plurality of component elements. In their broadest context, such component elements include the table golfer, the table tennis ball, and the golf course. Each of the components specifically configured and correlated with respect to each other so as to attain the desired objective.

More specifically, the system 10 of the present invention has its central component the portable table golfer 12. Such table golfer comprises a base plate 14. The base plate is positionable in a horizontal orientation on a table. The table golfer has a lower surface 16 and an upper surface 18.

A pair of vertically oriented upstanding supports 22 and 24 extend upwardly from the upper surface of the base plate. An aperture 26 and 28 extends through each upstanding support of the base plate. Such apertures are at different elevational orientations. They are, however, in axial alignment.

A support shaft 32 is rotatably supported within the aperture. The support shaft has a handle 34 at its upper end. This is for grasping by a user to effect rotation of the shaft and striking the ball as will be later described. In association with the table golfer is a miniature shaft 36. Such shaft extends downwardly from a central extent of the support shaft. The miniature shaft has an adjustment mechanism 38 centrally located along its length. The adjustment mechanism is for varying the effected length of the miniature shaft. Adjustment is made between the upper and lower halves of the shaft through a C-shaped clamp and adjustment bolt with associated nut extending through an aperture in the lower shaft half. Loosening the nut allows adjusting the angle between the upper and lower halves of the miniature shaft while tightening. Similarly, tightening the nut secures the miniature shaft with a proper central angle for effectively varying the length thereof.

Greater refinement can be made in the shot making during the play of miniaturized golf in accordance with the present invention. More specifically, the adjustment mechanism 38 between the upper and lower halves of the shaft 36 is arranged in a unique fashion. When the adjustment mechanism, the lockable pivot, is left unlocked, it will allow centrifugal force to swing the lower club half freely. In this manner, the rotation of the handle 34 by a particular force applied by the player, will vary the extent of centrifugal force acting upon the lower half of the shaft to more closely simulate the action of a real golf shot on a real golf course. Varying the force applied by the user through the handle 34 not only varies the centrifugal force resulting in different striking forces of the club handle on the ball, such will also vary the angle between the upper half and lower half of the shaft for even greater refinement of the shot requiring extending skill of the player.

Next provided as part of the table golfer is a golf club head 42. The head is located at the bottom of the miniature shaft. The golf club head has an adjustment mechanism 44 between the lower end of the miniature shaft and the heel portion of the head. The adjustment mechanism functions for varying the angle of the golf club head when in operation and use. Such adjustment mechanisms include a pair of facing disks with mateable tee therebetween. A bolt if formed in one of the disks and extends through an axial aperture in the other of the disks. A nut is associated therewith for loosening to adjust the angle and tightening to retain such angle of the golf club head.

Also as part of the table golfer is a tee 48. Such tee is located on the upper surface of the base plate. It functions for retaining a ball to be hit at an elevated location with the ball being hit as a function of the orientation of the shaft as dictated by the adjustment between the miniaturized shaft and head, the adjustment at the central extent of the miniaturized shaft and the degree and strength at which the support shaft is rotated by the player.

As a further refinement of the present invention, to more accurately simulate the action of a real golfer on a real golf course, the tee 48 is preferably fabricated with adjustment capabilities. More specifically, a longitudinal slot 47 is formed in the upper surface of the base plate 14. Such slot is aligned in the direction of club head movement through the ball. An enlarged extension 49 of the tee is located beneath the slot. It is sized for being retained within the slot following a hit. As a result, the tee may be moved forwardly and/or rearwardly with respect to the lowest point of club head swing during play. Golf shots with the device may thus be adjusted in accordance with the positioning of the tee 48.

The next component of the system is the ball 50. The preferred ball is a conventional table tennis ball. It is adapted to be positioned on the tee for being struck by the golf club head at the end of the swinging miniaturized shaft.

The next component of the system 10 is the miniaturized golf course 58. The golf course comprises a wide rectangular tee area 60. The course also includes a generally flat irregularly shaped putting area 62. The putting area has a hole 64 for receiving the ball during play. The golf course also has a curved elongated fairway area 66 between the tee and the putting area. These three areas of the golf course, the tee, the putting area and the fairway area are preferably of separate construction whereby different areas may be mixed and matched for providing the greatest variety to play. In addition, the tee area and fairway area are preferably provided with upstanding lateral side supports to maintain the ball in play during operation and use of the system. In this manner, the miniaturized golfer may be placed on the tee area with the ball on the tee. The ball may be then struck along the fairway toward the hole as a function of the length of the miniaturized shaft, the angle of the club head, and the extent of rotation of the support shaft.

In order to properly putt a ball 50 on the putting surface 62 toward and into the hole 64, a second club head in the form of a putter head 70 is provided. The head of the putter is secured at its upper end to the lower end of a shaft 72. The shaft 72 in turn is bent at an intermediate extent to form a horizontal extension 74. The central extent at the central extension is positioned in a horizontal aperture 76. Such aperture is located in the upper portion of the vertical support 22. In this manner, the device may be positioned on the green for putting with the sole of the putter adjacent to the putting surface. Consequently, the teeing up of a ball for making a shot on the putting surface does not require the utilization of a tee 48. Putting is effected by properly positioning the putter head 70 adjacent to the ball 50 being struck. The player may then grasp the handle 78 to rotate extension 74 and shaft 72 to effect the striking of a ball with a putting stroke.

The present invention is a toy that simulates a golf club, used to hit a golf ball, actually a table tennis ball, toward a hole located a few feet away. It is a game that can be played inside by golfers and others who enjoy a competitive sport or game.

The present invention is made of plastic, steel, aluminum and rubber. Its base is one piece that measures about 10 inches long by 7 inches wide by 1 to 1½ inches thick, and has an open right triangle atop each leg created by a centered cutout in the front of the base that measures about 5 inches square. Two coaxial holes are centered in the apex of the triangles. A round rod with handlebar grips on each end is inserted through the holes. Eccentric disks, mounted around and keyed to the rod, are located adjacent to the holes on the outside of the triangles, enabling the height adjustment needed for a change in the pitch of the golf club head. Mounted perpendicularly to the rod and located between the two triangles is a shalt with a head similar to the head of a golf club. The head has an adjustable face, i.e., open for a slice, closed for a hook, and square for a straight shot and the adjustable pitch or loft. The present invention is intended to be used with a table golf course with tees, fairways, and greens, but on a smaller scale. The table could be made of fiberglass or plastic or some other easily molded material and covered with artificial turf.

To use the present invention, one places it on the floor or table top with a table tennis ball in front of the club facing away from them, places one hand on top of the base to steady it, grasps one of the handlebar grips with the other hand, and twists the shaft, causing the club's head to hit the ball and propel it toward the target hole.

The present invention is a game that can furnish many hours of pleasure to adults as well as children. It could be fabricated from readily available materials at a reasonable cost.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved table golfer and golf course comprising, in combination:

a portable table golfer comprising a base plate positionable in a horizontal orientation on a table, the golfer having a lower surface and an upper surface, a pair of upstanding supports extending upwardly from the upper surface of the base plate with an aperture extending through each, the apertures being at different elevational orientations in axial alignment, a support shaft having an upper end and a lower end rotatably supported within the apertures and having a handle at the upper end thereof, a miniature shaft extending downwardly from a central extent of the support shaft with an adjustment mechanism centrally located therein for varying the effective length of the miniature shaft, a golf club head with a planar face located at the lower end of the shaft with an adjustment mechanism between the lower end of the miniature shaft and the head for varying the angle of the golf club face within the vertical, a tee located on the upper surface of the base plate for retaining a ball to be hit by the planar face;

a table tennis ball positionable on the tee for being struck by the swinging shaft; and a miniaturized golf course comprising a wide rectangular tee area, a generally flat irregularly shaped putting area with a hole and a curved elongated fairway therebetween whereby the miniaturized golfer may be placed on the tee area and the ball struck along the fairway toward the hole as a function of the length of the miniature shaft, the angle of the club head and the extent of rotation of the support shaft.

2. A portable table golfer comprising a base plate positionable in a horizontal orientation on a table, the golfer having a lower surface and an upper surface, a pair of upstanding supports extending upwardly from the upper surface of the base plate with an aperture extending through each, the apertures being at different elevational orientations in axial alignment, a support shaft having an upper end and a lower end rotatably supported within the apertures and having a handle at the upper end thereof, a miniature shaft extending downwardly from a central extent of the support shaft with an adjustment mechanism centrally located therein for varying the effective length of the miniature shaft, a golf club head located at the lower end of the shaft with an adjustment mechanism between the lower end of the miniature shaft and the head for varying the angle of the golf club head, a tee located on the upper surface of the base plate for retaining a ball to be hit by the orientation of the shaft.

3. The apparatus as set forth in claim 2 and further including:

a table tennis ball positionable on the tee for being struck by the swinging shaft.

4. The apparatus as set forth in claim 2 and further including:

a miniaturized golf course comprising a wide rectangular tee area, a generally flat irregularly shaped putting area with a hole and a curved elongated fairway area therebetween whereby the miniaturized golfer may be placed on the tee area and the ball struck along the fairway toward the hole as a function of the length of the miniature shaft, the angle of the club head and the extent of rotation of the support shaft.

5. The apparatus as set forth in claim 2 and further including adjustment means associated with a tee to effect the positioning of the tee with respect to the club head.

* * * * *